United States Patent [19]

Takumi

[11] Patent Number: 4,503,694

[45] Date of Patent: Mar. 12, 1985

[54] SPRING MANUFACTURING MACHINE EQUIPPED WITH TWO MOTORS

[75] Inventor: Hiroshi Takumi, Neyagawa, Japan

[73] Assignee: Shinko Kikaikogyo Kabushiki Kaisha, Osaka, Japan

[21] Appl. No.: 386,216

[22] Filed: Jun. 8, 1982

[30] Foreign Application Priority Data

Aug. 26, 1981 [JP] Japan ..... 56-133870
Aug. 26, 1981 [JP] Japan ..... 56-126124[U]

[51] Int. Cl.[3] ..... B21F 3/00
[52] U.S. Cl. ..... 72/131; 72/137
[58] Field of Search ..... 72/131, 132, 134, 135, 72/137; 192/0.098, 48.92

[56] References Cited

U.S. PATENT DOCUMENTS

| | | | |
|---|---|---|---|
| 3,025,889 | 3/1962 | Clay | 72/137 |
| 3,934,445 | 1/1976 | Lampietti | 72/129 |
| 3,983,732 | 10/1976 | Noyce | 72/137 |
| 4,030,327 | 6/1977 | Collins et al. | 72/131 |
| 4,112,721 | 9/1978 | Takase et al. | 72/132 |
| 4,173,135 | 11/1979 | Lamperti | 72/131 |

FOREIGN PATENT DOCUMENTS

| | | | |
|---|---|---|---|
| WO81/00974 | 4/1981 | PCT Int'l Appl. | 72/132 |

*Primary Examiner*—Francis S. Husar
*Assistant Examiner*—Jorji M. Griffin
*Attorney, Agent, or Firm*—Armstrong, Nikaido, Marmelstein & Kubovcik

[57] ABSTRACT

The present invention relates to a spring manufacturing machine equipped with two motors, which includes a wire feeding motor, a tool operating motor, and a control unit for controlling functions of these motors. The spring manufacturing machine is provided with an auxiliary feed mechanism so that wire feeding rollers as well as tools such as a coiling tool, etc. may be operated by the tool operating motor, and is capable of operating the tool and wire feeding rollers in timed relation by the tool operating motor, without necessity for frequent starting and shutting down of the tool operating motor and wire feeding motor even in the case where complicated processing is to be imparted to springs. Furthermore, the machine according to the present invention includes a horizontal table, a pair of wire feeding rollers provided on the upper surface of the table, a required number of movable tool support members also provided on the upper surface of the table, and a control unit mounted on support columns erected on the table, with a control panel face of the control unit being directed towards the front side of the machine, and therefore, the spring manufacturing machine of the present invention is extremely compact in size as compared with conventional spring manufacturing machines in which the control unit is provided separately from the spring manufacturing machine.

7 Claims, 7 Drawing Figures

FIG. 6
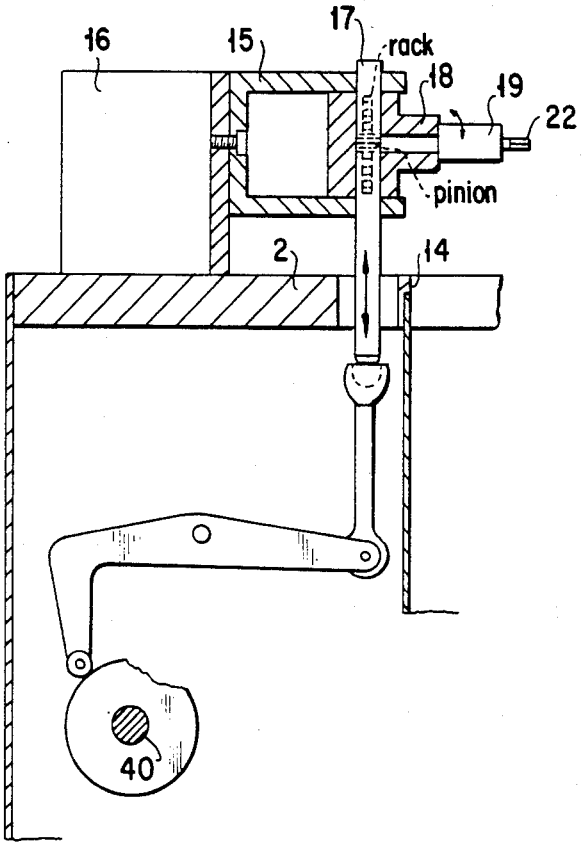
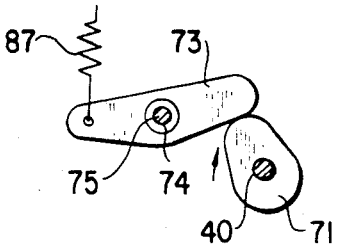
FIG. 7

SPRING MANUFACTURING MACHINE EQUIPPED WITH TWO MOTORS

BACKGROUND OF THE INVENTION

The present invention relates to a spring manufacturing machine and more particularly, to a spring manufacturing machine equipped with two electric motors.

Recently, following the tendency to cost reduction and wide use of control units including numerical control devices, computers, etc., there has been developed in the field of spring manufacturing machines also, an arrangement which is provided with two electric motors, i.e. one motor for wire feeding and the other motor for operating tools such as coiling tools, cutting tools, etc., with the two motors being arranged to be controlled by a control unit, so as to replace the conventional arrangement in which the wire feeding and tool operation are effected by one motor.

The newly developed spring manufacturing machine of the above described type, however, still has disadvantages as follows. In the first place, for applying complicated processings to the springs, for example, in the case where front and rear ends of a spring are to be processed, it is necessary to frequently start or stop the wire feeding motor and the tool operating motor by the control unit, and therefore, predetermined response time is inevitably required for the starting and shutting down of the respective motors, with a consequent certain limitation to the number of springs to be produced per hour, thus making it difficult to manufacture springs on a large scale through mass-production. Secondary, since the conventional spring manufacturing machine includes a pair of upper and lower wire feeding rollers provided at one side of a vertical front wall, and also a required number of tool supporting members radially arranged on the front wall about a wire processing section (i.e. wire processing space) provided at the forward portion with respect to the feed-out direction of these wire feeding rollers, the front portion of the spring manufacturing machine, particularly, the portion thereof convenient for operations whereat an operator can readily watch the processings and easily manipulate the machine as he stands, has been undesirably blocked. Accordingly, the control unit could not be incorporated into the spring manufacturing machine, thus making it necessary to separately produce and dispose the control unit and the spring manufacturing machine for connection therebetween by a cord and the like. However, separate production and individual installation of the control unit and the spring manufacturing machine as described above not only results in cost increase, but requires an extra site for disposition of the control unit, thus presenting an obstacle to the effective utilization of the site of a factory.

SUMMARY OF THE INVENTION

Accordingly, it is a primary object of the present invention to provide an improved spring manufacturing machine which is so arranged that the wire material may be fed also by a tool operating motor depending on necessity, while, during complicated processings of springs, not only the tools are operated by the tool operating motor, but the wire feeding rollers may also be driven thereby for improved productivity.

It is another important object of the present invention to provide an improved spring manufacturing machine of the above described type in which the wire feeding rollers and tool supporting members, etc. are properly arranged in the disposition thereof, thereby to install the control unit in a position where it is easily matched and readily accessible by the operator for an efficient operation.

In order to accomplish these and other objects, according to one preferred embodiment of the present invention, there is provided a spring manufacturing machine which includes a wire feeding motor controllable for its stopping position and rotational speed, a tool operating motor having function similar to that of said wire feeding motor, a control unit for controlling functions of said two motors, a required number of auxiliary feeding cams mounted on tool operating cam shafts or on shafts rotating in association therewith, rocking arms mounted on an auxiliary feeding shaft through one-way clutches so as to be subjected to rocking motion directly by said auxiliary feeding cams or through rocking levers, and means for transmitting rotation of said auxiliary feeding shaft to wire feeding rollers. The present invention is further provided with a horizontal table, a pair of wire feeding rollers disposed on the upper surface of said table, a required number of movable tool support members provided on the upper surface of said table, and a control unit mounted on support columns erected on said table, with a control panel face thereof directed towards the front side of the machine.

BRIEF DESCRIPTION OF THE DRAWINGS

FIG. 6 is cross-section taken along the line VI—VI in FIG. 3, and FIG. 7 shows a fragmentary side elevational view of an alternate embodiment of a power transmission means similar to FIG. 5.

DETAILED DESCRIPTION OF THE PREFERRED EMBODIMENT

It is to be noted that hereinbelow, throughout the present specification and appended claims, "front portion" means the left side in FIG. 2, "rear portion" represents the right side in FIG. 2, "left" means the left side in FIG. 1, and "right" denotes the right side in FIG. 1.

Figure 1:
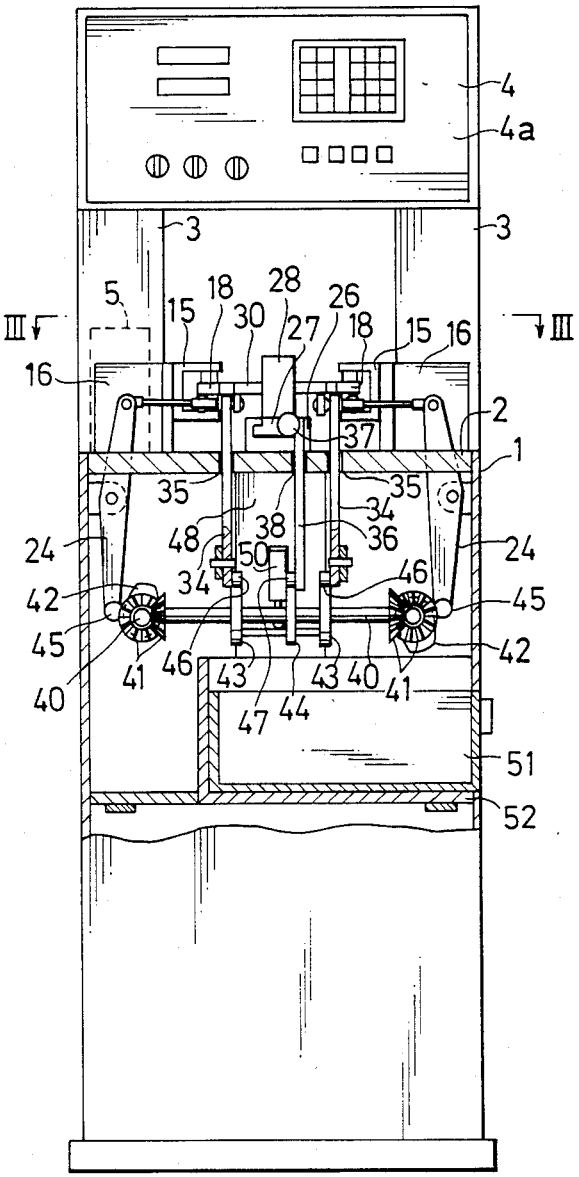
FIG. 1 is a front elevational view, partly broken away, of a spring manufacturing machine equipped with two motors according to one preferred embodiment of the present invention.
Figure 2:
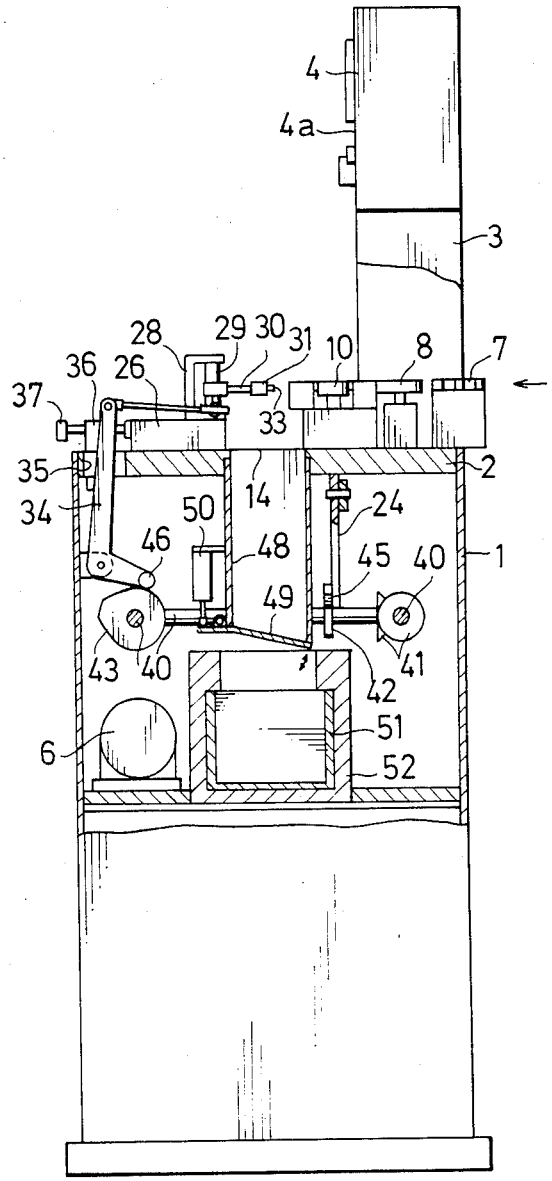
FIG. 2 is a side elevational view, partly broken away, of the spring manufacturing machine of FIG. 1.

Referring now to the drawings, there is shown in FIGS. 1 and 2, a spring manufacturing machine according to the present invention, which includes a machine frame 1, a horizontal table 2 provided at the upper portion of the machine frame 1, hollow cylindrical support columns 3, 3 erected on respective rear corners of said horizontal table 2, and a control unit 4 including a micro-computer, a pulse generator, and memory means, etc., and mounted on said support columns 3, 3, with a control panel face 4*a* thereof directed towards the front portion of the spring manufacturing machine. It should be noted here that the number of the support columns 3, 3 is not limited to two, but may be altered to any number depending on necessity, and that the length of said support columns 3, 3 may be set as desired. The control unit 4 is arranged to control a wire feeding motor 5 (see FIG. 1) accommodated in the support column 3 at the left side and a tool operating motor 6 (see FIG. 2) accommodated in the machine frame 1, and also, to be capable of memorizing a required amount of programs. Each of the motors 5 and 6 is constituted by a motor controllable for its stopping position and rotational speed such as a pulse motor, DC servo-motor or the like.

Figure 3:
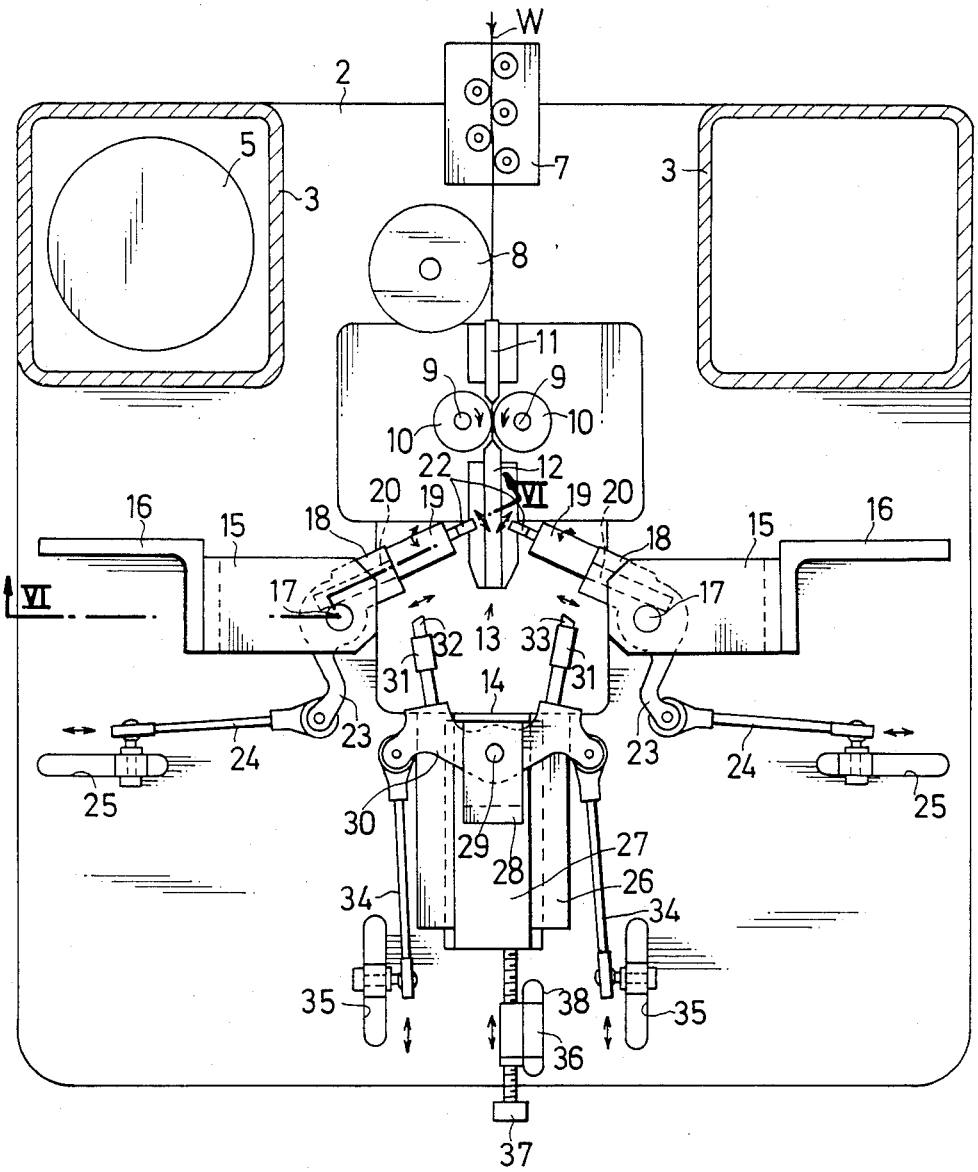
FIG. 3 is a cross section taken along the line III—III in FIG. 1.

Referring also to FIG. 3, on the rear central upper surface of the table 2, there is mounted a corrector 7, and at the forward left side of said corrector 7, a roller 8 is disposed for imparting a predetermined set to a wire material W. Meanwhile, at the forward right side of the roller 8, a pair of wire feeding rollers 10, 10 having their shafts 9, 9 vertically directed are provided, and these wire feeding rollers 10, 10 are arranged to be rotated by the wire feeding motor 5 through a transmission mechanism, for example, of gears or the like to be described later. At the rear and front sides of the wire feeding rollers 10, 10, there are provided wire guides 11 and 12, and the forward portion of the front side guide 12 is formed into a wire processing section 13 (wire material processing space). In a portion of the table 2 facing the above wire processing section 13, a spring discharge opening 14 is formed. Moreover, on the table 2 of the left and right sides of the spring discharge opening 14, a pair of left and right support members 16 are secured, and to each of these support members 16, a bracket 15 having a C-shape at its front side is displaceably mounted. A pin 17 having a rack portion at its intermediate portion along tne length thereof is rotatably and vertically movably (i.e. in a direction perpendicular to the paper surface in FIG. 3) fitted into each of the brackets 15, and a tool support member 18 is attached to the pin 17 so as not to be vertically moved together with said pin. Furthermore, as in FIG. 6, a tool holder 19 is rotatably fitted into each of said tool support members 18, and a pinion formed at the forward end of a shaft 20 of the above tool holder 19 is in mesh with a rack of the pin 17 described earlier so that the tool holder 19 may rotate with respect to the tool support member 18 by vertically moving the pin 17. The tool holder 19 is mounted with a hook forming tool 22 so as not to collide with the wire guide 12. Meanwhile, to an arm 23 of each of the tool support members 18, a link mechanism 24 for rocking said member 18 about the pin 17 is connected, and said link mechanism 24 extends into the machine frame 1 through each of elongated openings 25 formed in the table 2. Each of the pins 17 as described above is also coupled to a link mechanism for subjecting said pin 17 to the vertical movement. By the arrangement as described in the foregoing, each of the hook forming tools 22 is capable of projecting towards the wire material processing section 13 without contacting the wire guide 12 or rotating about its own axis.

On the other hand, a slide member 27 is guided for forward and backward movements by a guide member 26 mounted on the upper surface of the table 2 at the forward side of the spring discharge opening 14, and said slide member 27 is normally urged for protrusion in the forward direction by spring means (not shown), etc., while an end of a bolt 37 provided at the upper end of a rocking lever 36 contacts the forward edge of the slide member 27 so as to prevent said slide member 27 from protruding forwardly. The rocking lever 36 extends into the machine frame 1 through an elongated through-hole 38 formed in the table 2. To the slide member 27, a bracket 28 having a C-shape at its side is attached, while a tool support member 30 is pivotally mounted to the bracket 28 through a pin 29. A pair of left and right tool holders 31, 31 are mounted to the tool support member 30, with a cutting tool 32 being attached to the holder 31 at the left side, and a coiling tool 33 attached to the holder 31 at the right side. At the left and right side opposite ends of the tool support member 30, link mechanisms 34 for rocking said member 30 are connected, and extend into the machine frame 1 through corresponding elongated openings 35 formed in the table 2.

Referring back to FIGS. 1 and 2, as described later, four tool operating cam shafts 40 rotated by the tool operating motor 6 are incorporated into the machine frame 1 in a rectangular configuration as viewed from a plane, and bevel gears 41 mounted to the opposite ends of each of the cam shafts 40 are arranged to be engaged with the bevel gears 41 of the neighboring cam shaft 40, and thus, upon transmission of rotation of the tool operating motor 6 to one of the cam shafts 40, the other three cam shafts 40 follow the rotation of said one cam shaft 40. To the respective cam shafts 40, there are mounted tool operating cams 42, 43 and 44 of required shapes corresponding to each of the link mechanisms 24 and 34 for operating the tool support members 18 and 30 and the slide member 27, and also, the rocking lever 36. These cams 42, 43 and 44 are in contact with cam followers 45, 46 and 47 provided at respective ends of the link mechanisms 24, 34 and rocking lever 36. For bringing the cam followers 45, 46 and 47 into contact with the respective cams 42, 43 and 44, each of the link mechanisms 24, 34 and the rocking lever 36 is provided with spring means (not shown) for direct or indirect urging thereof. It is to be noted that the pins 17 fitted into the left and right side brackets 15 are also arranged to move upwardly or downwardly by the construction similar to that described earlier.

As shown in FIG. 2, the spring discharge opening 14 of the table 2 is provided with a chute 48, at the lower end of which chute 48, a bottom plate 49 is pivotally connected for selective opening or closing thereof by a hydraulic cylinder 50 mounted to said chute 48. Below the chute 48, a spring box 51 of a drawer type is located so as to be guided by a guide 52 attached to the machine frame 1.

Figure 4:
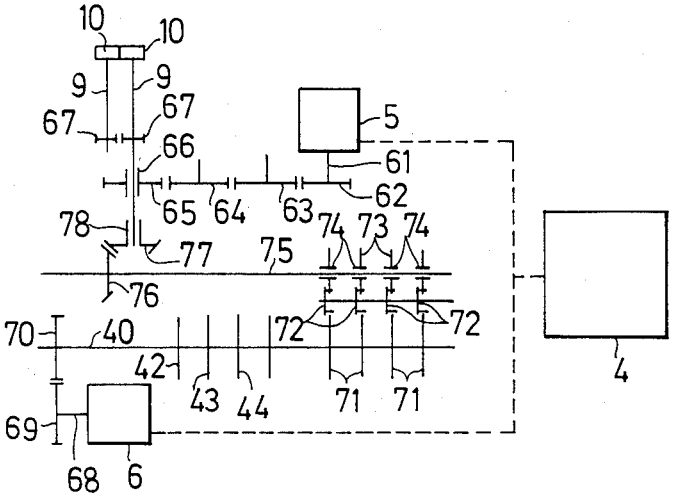
FIG. 4 is a diagram explanatory of a power transmission system for the spring manufacturing machine according to the present invention.

Subsequently, referring to FIGS. 4 and 5, a power transmission system for the spring manufacturing machine described so far will be explained. It should be noted that most of members, etc. illustrated in FIGS. 4 and 5 are not shown in FIGS. 1 to 3 so as to avoid excessive complication of the latter drawings.

Rotation of a gear 62 mounted on an output shaft 61 of the wire feeding motor 5 is transmitted, through gears 63 and 64, to a gear 65, which is mounted on the shaft 9 of one roller 10 via a so-called one-way clutch 66 for outputing its rotation only in one direction. On the respective shafts 9 of the pair of rollers 10, 10, gears 67, 67 engaging each other are mounted, and in synchronization with the shaft 9 mounted with the gear 65, the other shaft 9 is also arranged to be rotated.

A gear 69 mounted on an output shaft 68 of the tool operating motor 6 described earlier is in mesh with a gear 70 fixedly fitted onto one of the tool operating cam shafts 40. On the cam shaft 40 (or on another cam shaft arranged to be associated therewith), a required number of auxiliary feeding cams 71 are mounted, and arranged to actuate rocking arms 73 through rocking levers 72 provided in correspondence to each of them. Each of these rocking arms 73 is mounted on an auxiliary feeding shaft 75 through a one-way clutch 74 for outputing rotation only in one direction. Accordingly, only the rocking motion in one direction of each of the rocking arms 73 is transmitted to the auxiliary feeding shaft 75.

Figure 5:
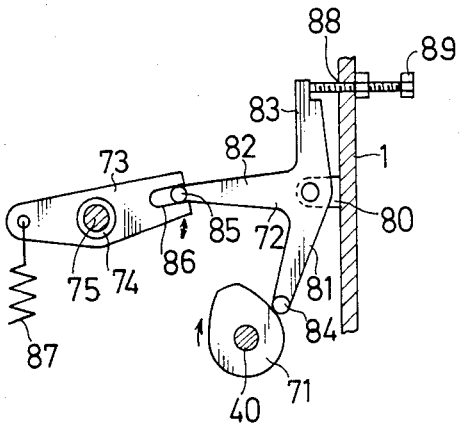
FIG. 5 is a fragmentary side elevational view showing on an enlarged scale, a power transmission means between a tool operating cam shaft and an auxiliary feeding shaft employed in the spring manufacturing machine according to the present invention.

FIG. 5 shows a specific example of the above construction for transmitting rotation of the cam shaft 40 to the auxiliary feeding shaft 75. In FIG. 5, the rocking lever 72 pivotally mounted on a bracket 80 within the machine frame 1 has three arms 81, 82 and 83, and a roller 84 mounted on the forward end of the arm 81 is in contact with the auxiliary feeding cam 71, while a roller 85 mounted at the formed end of the arm 82 is fitted into a notch 86 of the rocking arm 73. Since the rocking lever 72 is imparted with a rotational force in the clockwise direction through the rocking arm 73 by a spring 87 attached to said rocking arm 73, the arm 83 is arranged to contact the forward end of a stopper 89 made of a threaded rod engaged with a corresponding threaded hole 88 in the machine frame 1, and thus, by altering the rocking limit position in the clockwise direction of the arm 83, i.e. of the rocking lever 72 through reciprocation of the stopper 89, the rocking angle of the rocking lever 72 by the auxiliary feeding cam 71 is varied so as to ultimately change the rocking angle of the rocking arm 73. More specifically, if the roller 84 at the forward end of the arm 81 is spaced from the auxiliary feeding cam 71 through rotation of the rocking lever 72 in the counterclockwise direction by projecting the stopper 89 towards the arm 83, the rocking angle of the rocking lever 72 by the auxiliary feeding cam 71 may be reduced, and consequently, the rocking angle of the rocking arm 73 can be decreased. If the rocking lever 72 is rotated to a position where the roller 84 is completely out of contact with the auxiliary feeding cam 71, the rocking lever 72 will not function at all. It is needless to say that the rocking arm 73 can be arranged to be directly moved for rocking motion by the auxiliary feeding cam 71 as shown in FIG. 7.

Referring back to FIG. 4, the auxiliary feeding shaft 75 is mounted with a bevel gear 76, which is engaged with another bevel gear 77 mounted on the shaft 9 of the roller 10 through a one-way clutch 78.

Subsequently, the method of operation and functioning of the spring manufacturing machine described so far will be explained hereinbelow.

In the first place, description will be given with reference to a case where springs are produced through utilization of the auxiliary feeding mechanism. In the above case, it is so prepared that, with the rocking angle of the respective rocking arms 73 being adjusted through adjustment of the position for the stopper 89, and with the desired program memorized in the control unit 4 having been called out, the spring manufacturing machine functions based on said program. After the preparation as described above, upon depression of the start switch of the control unit 4, the spring manufacturing machine carries out the predetermined functions on the basis of the program to produce springs. For example, on the assumption that coil springs having hooks at opposite ends thereof are to be produced, the tool operating motor 6 first functions to rotate the tool operating cam shafts 40, whereby the hook forming tool 22, coiling tool 33 and slide member 27 are actuated through the link mechanisms 24 and 34 and the rocking lever 36, at the predetermined period by the tool operating cams 42, 43, and 44, while the shafts 9 of the rollers 10 are driven for rotation of said rollers 10, 10 through the rocking lever 72, rocking arm 73 and auxiliary feeding shaft 75, by the respective auxiliary feeding cams 71, and in timed relation with the functioning of the tool, the wire W held between the rollers 10, 10 under pressure is fed out towards the wire material processing section 13 so as to effect a forward end processing of coil springs. It is to be noted here that, during the above period, since the wire feeding motor 5 is kept shut down, each of the gears 62 to 65 is not rotated, but owing to the arrangement that the gear 65 is mounted on the shaft 9 of the roller 10 through the one-way clutch 66, there is no possibility that the rotation of the shaft 9 is prevented by the stopped gear 65. Upon completion of the forward end processing of the coil spring in the above described manner, the tool operating motor 6 is stopped, and in turn, the wire feeding motor 5 is rotated. Accordingly, the shafts 9 are rotated through the gears 62 to 65 for rotation of the rollers 10, 10, and thus, wire feeding is effected at a high speed so as to push forward the wire W towards the coiling tool 33 located in the forward position for winding the body portion of the coil spring. Since the tool operating motor 6 is kept shut down during the above period, the bevel gear 77 at the lower end of the shaft 9 is not rotated, but owing to the presence of the one-way clutch 78 therebetween, there is no possibility that the rotation of the shaft 9 for the roller 10 is prevented by the stopped bevel gear 77. Upon completion of the winding for the body portion of the spring, the wire feeding motor 5 is stopped, with the tool operating motor 6 being actuated again so as to effect the rear end processing of the spring in the similar manner as in the forward end processing as described earlier. Thereafter, the cutting tool 32 is operated to cut off the finished coil spring, and subsequently, the forward end processing of a next spring is effected through rotation of the tool operating motor 6 in the similar manner as described previously, and thus, coil springs are continuously manufactured. As explained earlier, the coil springs cut off by the cutting tools 32 are successively dropped, through the discharge opening 14, into the chute 48 so as to be once stored therein, and when a predetermined amount of springs are stored, the bottom plate 49 is opened for dropping the springs into the spring box 51.

If the springs are directly dropped into the spring box 51 without being one stored in the chute 48, there has been such a problem that, selection between good and faulty products is required, if any faulty items are involved, but owing to the arrangement for once storing the springs in the chute 48 as described above, there is such an advantage that, even if any faulty items are produced, only the springs in the chute 48 may be disposed of as faulty products.

By the operating method of the spring manufacturing machine as described above, it is possible to produce a large number of springs in an efficient manner.

Subsequently, explanation will be given to another case for manufacturing springs through alternate operations, etc. of the two motors 5 and 6 by the control unit 4, without employment of the auxiliary feeding mechanism.

In the above case, it is so prepared that the auxiliary feeding shaft 75 is not rotated even if the cam shafts 40 are rotated, for example, by removing all the auxiliary feeding cams 71 of the cam shafts 40 or by preventing contact between the auxiliary feeding cams 71 and rollers 84 through protruding of the stoppers 89 towards the arms 83, etc., while desired program of the programs memorized in the control unit 4 is preliminarily called out. After the preparation as described above, upon depression of the start switch, the wire feeding motor 5 and tool operating motor 6 are repeatedly started and stopped according to the instructions by the control unit 4 so as to effect the feeding of the wire by the wire feeding motor 5, and on the other hand, to carry out operations of the coiling tool 33, cutting tool 32, hook forming tool 22, etc. by the tool operating motor 6, for performing production of springs. In the above case, various kinds of springs may be readily produced only by causing many programs to be memorized in the control unit 4 to call out the desired program depending on requirements, without necessity for replacement of cams or the like as in the conventional spring manufacturing machines.

What is claimed is:

1. A spring manufacturing machine which comprises wire feeding rollers, a wire feeding motor means having controllable stopping position and rotational speed, means operatively associating said rollers with said wire feeding motor means, a tool operating motor means having controllable stopping position and rotational speed, a control unit for controlling functioning of said two motor means, a plurality of auxiliary feeding cams mounted on tool operating cam shafts rotated by said tool operating motor means, rocking arms arranged to be subjected to rocking motion indirectly through rocking levers and being mounted on an auxiliary feeding shaft through one-way clutches, and means for transmitting rotation of said auxiliary feeding shaft to said wire feeding rollers.

2. A spring manufacturing machine as claimed in claim 1, wherein said wire feeding motor means and said tool operating motor means are each a pulse motor.

3. A spring manufacturing machine as claimed in claim 1, further including stopper members displceably mounted for their position on a machine frame, and arranged to be brought into contact with said rocking levers.

4. A spring manufacturing machine as claimed in claim 1, wherein said wire feed rollers are each mounted on a roller shaft, and said auxiliary feeding shaft is mounted with a bevel gear, which engages another bevel gear mounted on one of said roller shafts through one-way clutch.

5. A spring manufacturing machine which comprises wire feeding rollers, a wire feeding motor means having controllable stopping position and rotational speed, means operatively associating said rollers with said wire feeding motor means, a tool operating motor means having controllable stopping position and rotational speed, a control unit for controlling functioning of said two motor means, a plurality of auxiliary feeding cams mounted on tool operating cam shafts rotated by said tool operating motor means, rocking arms arranged to be subjected to rocking motion directly by said auxiliary feeding cams and being mounted on an auxiliary feeding shaft through one-way clutches, and means for transmitting rotation of said auxiliary feeding shaft to said wire feeding rollers.

6. A spring manufacturing machine as claimed in claim 5, wherein said wire feeding motor means and said tool operating motor means are each a pulse motor.

7. A spring manufacturing machine as claimed in claim 5, wherein said wire feed rollers are each mounted on a roller shaft, and said auxiliary feeding shaft is mounted with a bevel gear, which engages another bevel gear mounted on one of said roller shafts through one-way clutch.

* * * * *